US011705079B2

(12) United States Patent
Wu et al.

(10) Patent No.: US 11,705,079 B2
(45) Date of Patent: Jul. 18, 2023

(54) COLOR IMAGE PROCESSING METHOD AND DEVICE, ELECTRONIC INK SCREEN, AND STORAGE MEDIUM

(71) Applicant: BOE Technology Group Co., Ltd., Beijing (CN)

(72) Inventors: Yanhong Wu, Beijing (CN); Hanwen Liu, Beijing (CN); Lijie Zhang, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 17/532,470

(22) Filed: Nov. 22, 2021

(65) Prior Publication Data

US 2022/0180823 A1 Jun. 9, 2022

(30) Foreign Application Priority Data

Dec. 7, 2020 (CN) ..... 202011439489.4

(51) Int. Cl.
*G09G 3/34* (2006.01)

(52) U.S. Cl.
CPC ..... *G09G 3/344* (2013.01); *G09G 2320/0666* (2013.01); *G09G 2340/06* (2013.01)

(58) Field of Classification Search
CPC ..... G09G 3/344
USPC ..... 345/590, 604
See application file for complete search history.

(56) References Cited

U.S. PATENT DOCUMENTS

2009/0297022 A1* 12/2009 Pettigrew ..... H04N 1/62 382/162
2011/0069331 A1* 3/2011 Honma ..... H04N 1/465 358/1.9
2013/0120431 A1* 5/2013 Kawaguchi ..... H04N 1/628 345/590
2016/0351103 A1* 12/2016 Park ..... G09G 3/2007
2017/0289408 A1* 10/2017 Morikawa ..... H04N 1/6019
2018/0099521 A1* 4/2018 Wu ..... B42D 25/309

OTHER PUBLICATIONS

Jarvis, John F., Charles N. Judice, and William H. Ninke. "A survey of techniques for the display of continuous tone pictures on bilevel displays " Computer graphics and image processing 5.1 (1976): 13-40.

* cited by examiner

*Primary Examiner* — Prabodh M Dharia
(74) *Attorney, Agent, or Firm* — IPro, PLLC

(57) ABSTRACT

The present application discloses a color image processing method, a color image processing device, an electronic ink screen, and a storage medium. The color image processing method includes: obtaining an original image, and transforming original color data of a pixel in the original image into corresponding set color data in a set color space; determining a target color corresponding to the pixel in a plurality of set colors according to the set color data corresponding to the pixel and a color ratio allocation table; and generating a target image according to the target color.

14 Claims, 9 Drawing Sheets

Original image

Target image

Original image

Target image

Original image

Target image

Original image

Target image

Original image Norm=255 Norm=90

Floyd-Steinberg dithering algorithm

JF Jarvis dithering algorithm

COLOR IMAGE PROCESSING METHOD AND DEVICE, ELECTRONIC INK SCREEN, AND STORAGE MEDIUM

CROSS-REFERENCE TO RELATED APPLICATIONS

The present application claims a priority to the Chinese patent application No. 202011439489.4 filed in China on Dec. 7, 2020, a disclosure of which is incorporated herein by reference in its entirety.

TECHNICAL FIELD

The present application relates to the field of display technologies, and in particular, to a color image processing method, a color image processing device, an electronic ink screen, and a storage medium.

BACKGROUND

With the development of electronic technologies, electronic ink screen display technology is more and more widely used. At present, most electronic ink screens usually only support displaying black and white colors. If a display is required, an image processor of the electronic ink screen usually transforms a color image into a halftone black-and-white display image according to a certain algorithm, for displaying by the electronic ink screen. In the related art, an electronic ink screen supporting multiple colors is proposed, but the ink screen supporting multiple colors can only display a black and white image. Therefore, how to transform color image data into multiple color image data while maximally saving information in an original image so as to fully exert capabilities of the electronic ink screen has become an urgent technical problem to be solved.

SUMMARY

In view of this, the present application provides a color image processing method, a color image processing device, an electronic ink screen, and a storage medium.

According to embodiments of the present application, a color image processing method includes: obtaining an original image, and transforming original color data of a pixel in the original image into corresponding set color data in a set color space; determining a target color corresponding to the pixel in a plurality of set colors according to the set color data corresponding to the pixel and a color ratio allocation table; and generating a target image according to the target color.

In some embodiments, the set color data includes first attribute data, second attribute data and third attribute data; the color image processing method further includes: determining first color allocation ratios of a plurality of set colors according to a range of the first attribute data; determining second color allocation ratios of the plurality of set colors according to the first color allocation ratios and the second attribute data; and determining third color allocation ratios of the plurality of set colors according to the second color allocation ratios and the third attribute data, thereby obtaining the color ratio allocation table.

In some embodiments, the set color space includes an HSV color space; the first attribute data includes hue data; the second attribute data includes saturation data; and the third attribute data includes value data.

In some embodiments, the determining a target color corresponding to the pixel in a plurality of set colors according to the set color data corresponding to the pixel and a color ratio allocation table, includes: determining a third color allocation ratio corresponding to each set color according to the set color data corresponding to the pixel and the color ratio allocation table; and determining the set color having a largest third color allocation ratio as the target color.

In some embodiments, the plurality of set colors include black and white, and any one or more of red, orange, yellow, green, and blue.

In some embodiments, the color image processing method further includes: determining a target RGB value of the target color; calculating an error value between the target RGB value and an initial RGB value; performing error truncation on the error value according to a preset Norm parameter to adjust color saturation of a target color image; and performing error diffusion on the error value through a preset error diffusion algorithm.

In some embodiments, the preset error diffusion algorithm includes: a Floyd-Steinberg dithering algorithm and a JF Jarvis dithering algorithm.

According to embodiments of the present application, an electronic ink screen includes: a processor and a memory; and one or more programs stored in the memory and executed by the processor. The processor executes the one or more programs to perform: obtaining an original image, and transforming original color data of a pixel in the original image into corresponding set color data in a set color space; determining a target color corresponding to the pixel in a plurality of set colors according to the set color data corresponding to the pixel and a color ratio allocation table; and generating a target image according to the target color.

According to embodiments of the present application, a non-volatile computer-readable storage medium includes: a computer program stored thereon; wherein the computer program is executed by one or more processors to causes the processors to perform: obtaining an original image, and transforming original color data of a pixel in the original image into corresponding set color data in a set color space; determining a target color corresponding to the pixel in a plurality of set colors according to the set color data corresponding to the pixel and a color ratio allocation table; and generating a target image according to the target color.

In the color image processing method, the color image processing device, the electronic ink screen and the storage medium of the embodiments of the present application, one target object is obtained by transforming original color data of an obtained original image into corresponding set color data in a set color space, determining a target color corresponding to a pixel in a plurality of set colors according to the set color data and a color ratio allocation table, and replacing the original color data of the pixel according to the target color. In this way, transformation of color image data into multi-color image data is achieved, and information in the original image is preserved to the maximum extent.

Additional aspects and advantages of the invention will be set forth in part in the description which follows and, in part, will be obvious from the description, or may be learned by practice of the invention.

BRIEF DESCRIPTION OF THE DRAWINGS

The foregoing and/or additional aspects and advantages of the present application will become apparent and more readily appreciated from the following description of the embodiments, taken in conjunction with the accompanying drawing, in which.

REFERENCE SIGNS OF MAIN ELEMENTS

Figure 1:
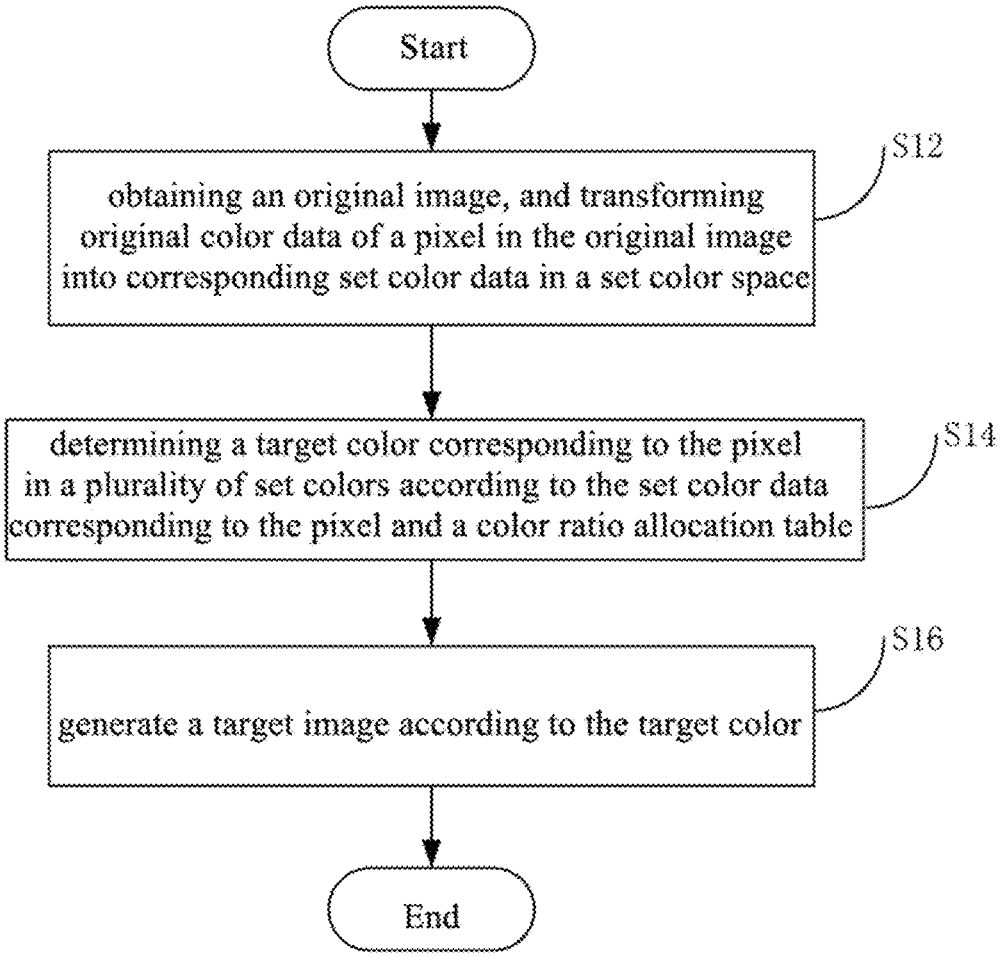
FIG. 1 is a flowchart of a color image processing method according to some embodiments of the present application.

Color image processing device 10; obtaining module 12; determination module 14; generation module 16; calculation module 18; adjustment module 19; electronic ink screen 100; processor 20; memory 30; program 32; storage medium 40; and computer program 42.

DETAILED DESCRIPTION

The present application will be further described in detail hereinafter with reference to the drawings and embodiments. It can be understood that the specific embodiments described here are only used to explain the relevant disclosure, but not to limit the disclosure. In addition, it should be noted that, for ease of description, only parts related to the disclosure are shown in the drawings.

With the development of electronic technologies, the electronic ink screen display technology has been rapidly developed and widely used in the past few years. For example, some products such as e-book readers, e-paper, and shelf labels, e-table tags, etc. use large numbers of e-ink screens.

The electrophoretic display (EPD) has become one of the popular choices for electronic ink screens due to its superior characteristics. First, the electrophoretic display is a reflective display that is more comfortable to read than a transmissive display. Second, the electrophoretic display is bistable, which can maintain an image on a viewing screen when no power is supplied, but consume power when the user refreshes the image. The electrophoretic display may be mainly classified into wet-type electrophoretic displays (which are realized by microcapsule or micro-cup techniques), and dry-type quick-response liquid powder display (QR-LPD). However, due to the special display mode of the ink screen, unlike conventional liquid crystal displays, the color gamut of the electrophoretic display is much lower than that of a standard RGB (SRGB) color space. The electrophoretic displays can only support displaying a small number of colors, for example, supporting two colors including black and white, or three colors including black, white and red.

At present, it is most common to transform a color image into two colors including black and white, which can be achieved only though binarizing a threshold. If it needs to be displayed, an image processor of an electronic ink screen usually transforms a color image into a halftone black and white display image according to a certain algorithm, for displaying by the electronic ink screen.

In the related art, an electronic ink screen supporting multiple colors is proposed, and the ink screen supporting multiple colors can only display a black and white image. Therefore, how to transform image data into multiple color image data while maximally saving information in an original image so as to fully exert capabilities of the electronic ink screen has become an urgent technical problem to be solved.

In view of this, referring to FIG. 1, one embodiment of the present application provides a color image processing method. The color image processing method includes the following steps:

Step S12: obtaining an original image, and transforming original color data of a pixel in the original image into corresponding set color data in a set color space;

Step S14: determining a target color corresponding to the pixel in a plurality of set colors according to the set color data corresponding to the pixel and a color ratio allocation table; and Step S16: generating a target image according to the target color.

Figure 2:
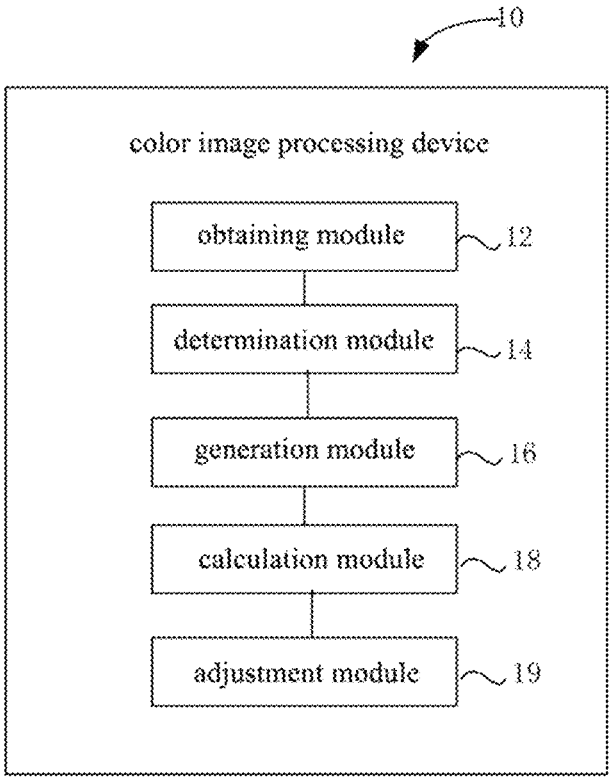
FIG. 2 is a schematic block diagram of a color image processing device according to some embodiments of the present application.

Referring to FIG. 2, one embodiment of the present application further provides a color image processing device 10. The color image processing device 10 includes an obtaining module 12, a determination module 14, and a generation module 16.

The foregoing step S12 may be implemented by the obtaining module 12, the foregoing step S14 may be implemented by the determination module 14, and the foregoing step S16 may be implemented by the generation module 16.

In other words, the obtaining module 12 may be configured to obtain an original image, and transform original color data of a pixel in the original image into corresponding set color data in a set color space.

The determination module 14 may be configured to determine a target color corresponding to the pixel in a plurality of set colors according to the set color data corresponding to the pixel and a color ratio allocation table.

The generation module 16 may be configured to generate a target image according to the target color.

Figure 3:
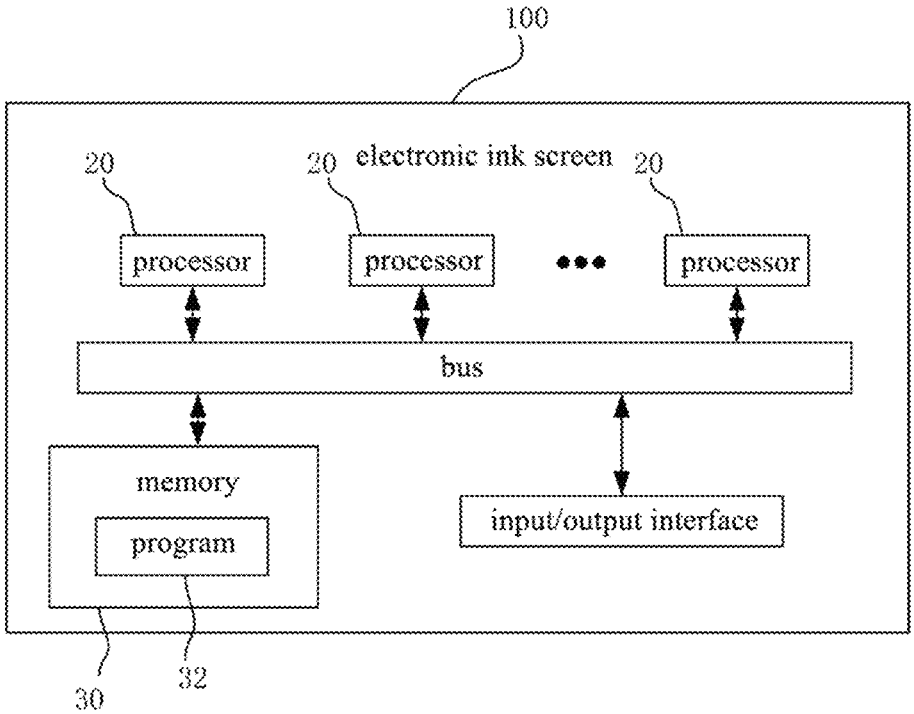
FIG. 3 is a schematic block diagram of an electronic ink screen according to some embodiments of the present application.

Referring to FIG. 3, an electronic ink screen 100 of the present application includes one or more processors 20, a memory 30, and one or more programs 32. The one or more programs 32 are stored in the memory 30 and executed by the one or more processors 20. The programs 32 are executed by the processors 20 to perform instructions of the foregoing color image processing method.

Figure 4:
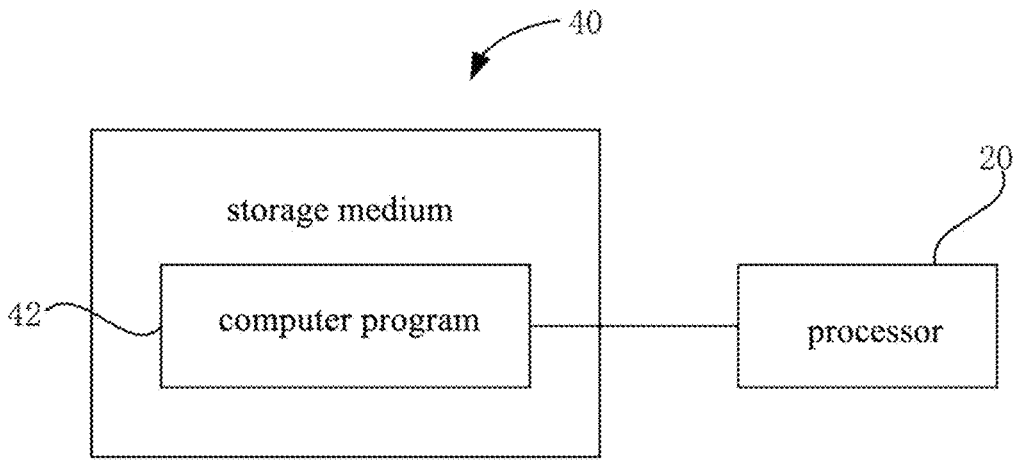
FIG. 4 is a schematic block diagram of a storage medium in connection with a processor according to some embodiments of the present application.

Referring to FIG. 4, one embodiment of the present application further provides a non-volatile computer-readable storage medium 40 that stores a computer program 42. The computer program 42 is executed by one or more processors 20 to causes the processors 20 to perform the foregoing color image processing method.

In the color image processing method, the color image processing device 10, the electronic ink screen 100 and the storage medium 40 of the embodiments of the present application, one target object is obtained by transforming original color data of an obtained original image into corresponding set color data in a set color space, determining a target color corresponding to a pixel in a plurality of set colors according to the set color data and a color ratio allocation table, and replacing the original color data of the pixel according to the target color. In this way, transformation of color image data into multi-color image data is achieved, and information in the original image is preserved to the maximum extent.

In some embodiments, the electronic ink screen 100 may be an electrophoretic display screen, and may be applicable to electronic devices such as electronic book readers, electronic paper, shelf labels, and electronic table cards. For example, the electronic ink screen 100 of the present application may be applied to an e-book reader, such that the e-book reader can display images in a variety of colors to enhance the user experience.

In some embodiments, the color image processing device 10 may be part of the electronic ink screen 100. In other words, the electronic ink screen 100 includes the color image processing device 10.

In some embodiments, the color image processing device 10 may be discrete components assembled in a manner to have the aforementioned functionality, or a chip in the form of an integrated circuit having the aforementioned functionality, or computer software codes that causes a computer to have the aforementioned functionality.

In some embodiments, as hardware, the color image processing device 10 may be an independent or additional peripheral component added to a computer or computer system. The color image processing device 10 may also be integrated into a computer or computer system. For example, when the color image processing device 10 is part of the electronic ink screen 100, the color image processing device 10 may be integrated into the processor 20.

In some embodiments, when the color image processing device 10 is part of the electronic ink screen 100, as software, code segments corresponding to the color image processing device 10 may be stored on the memory 30 for execution by the processor 20 to perform the aforementioned functions. In other words, the color image processing device 10 includes the aforementioned one or more programs 32, or the aforementioned one or more programs 32 include the color image processing device 10.

In some embodiments, the computer-readable storage medium 40 may be a storage medium that is built into the electronic ink screen 100, such as the memory 30, or a storage medium that is pluggable into the electronic ink screen 100, such as an SD card or the like.

It should be noted that since the RGB mode is a physical color mode of a display device, an image displayed on the display device finally appears in the RGB mode; while when the image is displayed on the electronic ink screen 100, original color data of the image is RGB color data. That is, original color data of a pixel in the original image is RGB color data. RGB is designed from the principle of color lighting, and RGB includes three color channels of red, green and blue. Each color is divided into 256 levels of brightness, and "lamp" is weakest at 0-it is switched off, and "lamp" is brightest at 255. When three-color grey values are the same, grey tones with different grey values are generated. When the three-color grey values are all 0, a darkest black tone is generated; when all the three-color grey values are all 255, a brightest white tone is generated. The RGB values refer to brightness and are expressed with integers. Generally, RGBs each have 256 levels of brightness, which are represented with numbers 0, 1, 2 . . . 254, 255.

It should also be noted that the number of pixels in the image may be one or more, and for a plurality of pixels, the plurality of pixels may be respectively processed to obtain corresponding original color data.

Those skilled in the related art can understand that the color space, also known as a color model (also known as color system), is used to describe colors in a generally accepted manner under certain criteria. The color space includes an RGB color space, a CMY color space, an HSV color space, and an HSI color space, etc. It is understood that a set color space refers to a predefined color space. In the present application, since a color image needs to be transformed into an image of only a few colors, transforming original color data into corresponding set color data in the set color space enables better data processing of colors of the pixel.

In the present application, the set color space is an HSV color space. That is, in the present application, the transforming original color data of a pixel in the original image into corresponding set color data in a set color space refers to: transforming RGB color data of a pixel in the original image into HSV color data.

Figure 5:
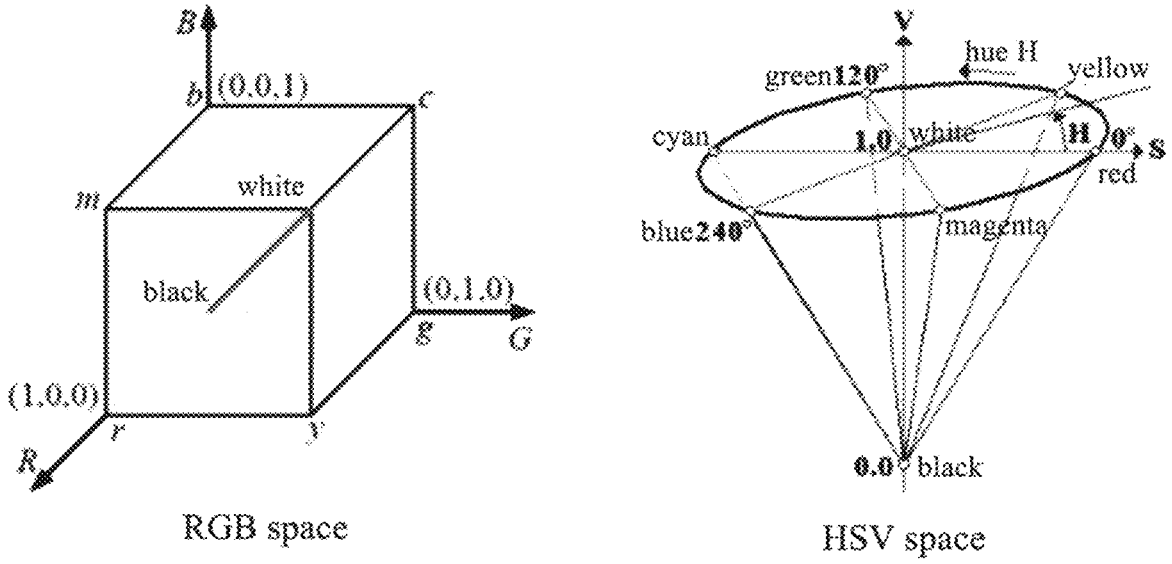
FIG. 5 is a schematic diagram of an RGB color space and an HSV color space according to some embodiments of the present application.

Referring to FIG. 5, the HSV color space is a color space proposed for better digital processing of colors, and is also known as the Hexcone Model. In the HSV color space, hue (H), saturation (S), value (V) are defined. The hue H is measured by an angle, and a value thereof is between 0 degrees and 360 degrees. From red in the counterclockwise direction, red is 0 degrees, green is 120 degrees, and blue is 240 degrees. Their complementary colors are that yellow is 60 degrees, cyan is 180 degrees, and magenta is 300 degrees.

The saturation (S) indicates the degree to which a color approaches a spectral color. A color may be seen as a result of mixing a spectral color with white. The greater the proportion of the spectral color, the greater the degree of color approaching the spectral color, and the greater the saturation of the color. With high saturation, the color is deep and bright. The white in the spectral color is zero and the saturation is highest. Generally, in a value range from 0% to 100%, the greater the value, the more saturated the color.

The value (V) represents the degree of color brightness. For a light source colors, the value is related to brightness of a luminous body; for object colors, the value is related to transmittance ratio or reflectance ratio of the object. Typical, the value ranges from 0% (black) to 100% (white).

Transformation formulas for transforming RGB color data into HSV color data are as follows:

$$R^* = \frac{R}{255}, G^* = \frac{G}{255}, B^* = \frac{B}{255}$$

$$C_{max} = \max(R^*, G^*, B^*), C_{min} = \min(R^*, G^*, B^*), \nabla = C_{max} - C_{min}$$

$$H = \begin{cases} 0, \nabla = 0 \\ 60*\left(\frac{G^* - B^*}{\nabla} + 0\right), C_{max} = R^* \\ 60*\left(\frac{B^* - R^*}{\nabla} + 2\right), C_{max} = G^* \\ 60*\left(\frac{R^* - G^*}{\nabla} + 4\right), C_{max} = B^* \end{cases}$$

$$S = \begin{cases} 0, C_{max} = 0 \\ \frac{\nabla}{C_{max}}, C_{max} \neq 0 \end{cases}$$

$$V = C_{max}$$

It should also be noted that the color ratio allocation table is used for classifying and allocating the set color data so as to generate the target color. The color ratio allocation table is configured with a plurality of set colors, and the plurality of set colors include three or more colors. Through the color ratio allocation table, the set color data can be mapped into set colors configured in the color ratio allocation table.

The number of pixels may be one or more. For a plurality of pixels, the plurality of pixels are respectively processed to obtain corresponding at least one set color configured in the color ratio allocation table.

Further, the set colors configured in the color ratio allocation table include black and white, and the set colors further include any one or more of red, orange, yellow, green, or blue.

For example, in the present application, the set colors configured in the color ratio allocation table include seven colors of red, orange, yellow, green, blue, black and white. That is, in the present application, any one set of color data can be mapped into corresponding colors of red, orange, yellow, green, blue, black and white.

When processing set color data, there may be one set color data or a plurality of set color data. For a plurality of set color data, each of the plurality of set color data is mapped into corresponding set colors according to the color ratio allocation table.

It should be understood from the above examples that, in the color image processing method in the present application, transformation of a color image into seven colors is described as an example. It is to be understood that the above is merely an example of the color image processing method and does not strictly limit an object to which the color image processing method in the embodiment of the present invention is applied.

Figure 6:
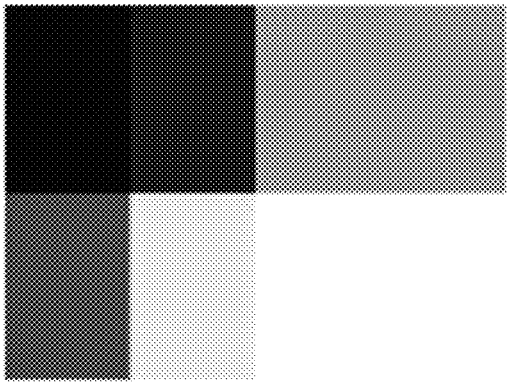
FIG. 6 is a schematic diagram of comparison between an original image and a target image according to some embodiments of the present application.
Figure 6:
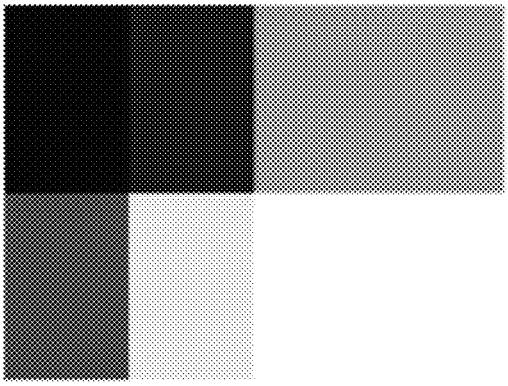
Figure 6:
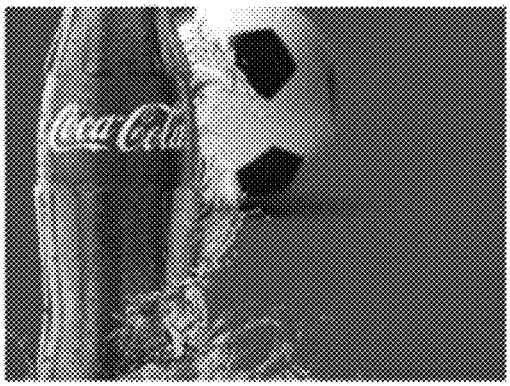
Figure 6:
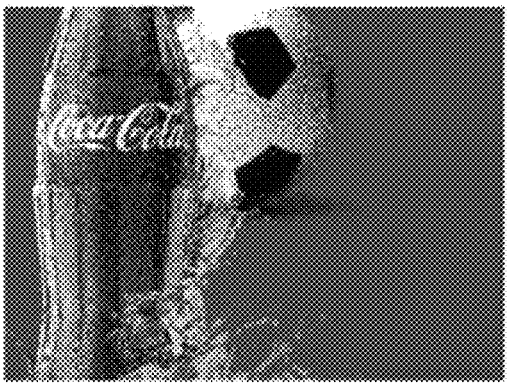
Figure 6:
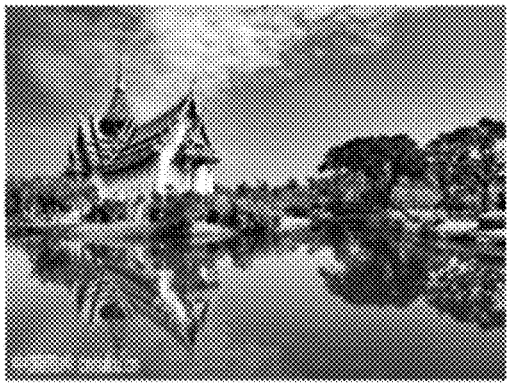
Figure 6:
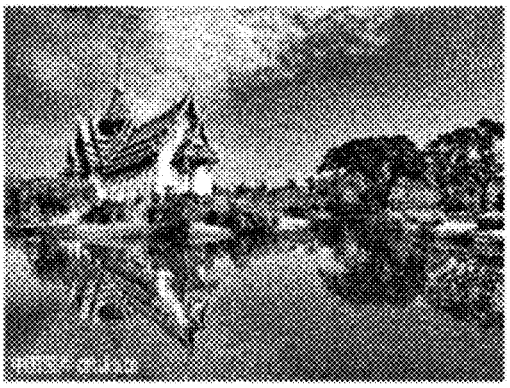

Referring to FIG. 6, after the target color is generated, the original image is traversed to replace initial color data of each pixel with corresponding target color, until all positions are processed, and then a target image is generated so as to be displayed on the electronic ink screen 100. In this way, the color image data can be transformed into multi-color image data while the information in the original image can being preserved to the maximum extent so as to fully exert capabilities of the electronic ink screen, thereby improving the user experience.

Figure 7:
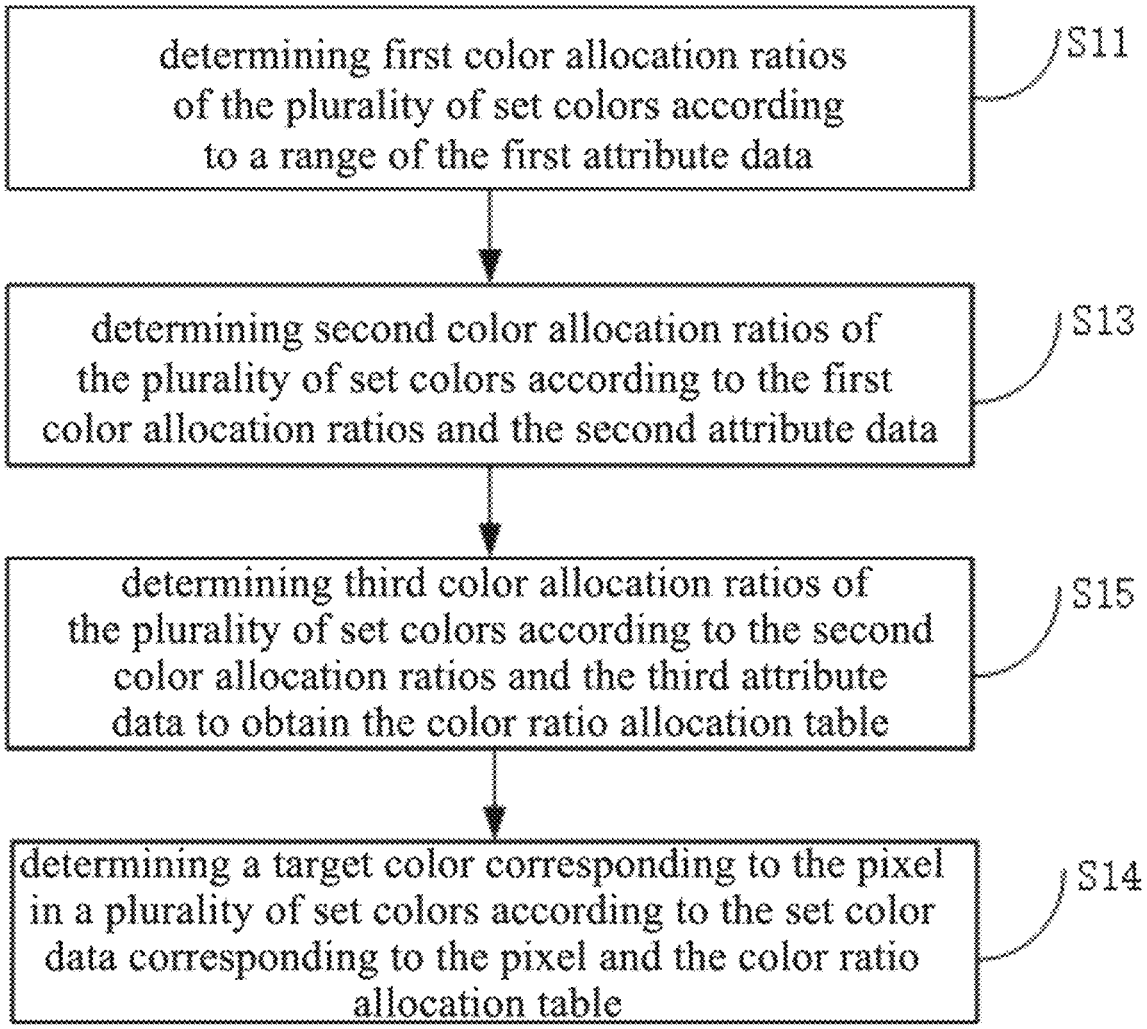
FIG. 7 is a flowchart of a color image processing method according to some embodiments of the present application.

Referring to FIG. 7, in some embodiments, the set color data includes first attribute data, second attribute data and third attribute data. Before the step S14, the color image processing method further includes:

Step S11: determining first color allocation ratios of a plurality of set colors according to a range of the first attribute data;

Step S13: determining second color allocation ratios of the plurality of set colors according to the first color allocation ratios and the second attribute data; and Step S15: determining third color allocation ratios of the plurality of set colors according to the second color allocation ratios and the third attribute data, thereby obtaining the color ratio allocation table.

Further, referring to FIG. 2, in some embodiments, the steps S11, S13, and S15 may be implemented by the determination module 14. That is, the determination module 14 may be configured to determine first color allocation ratios of a plurality of set colors according to a range of the first attribute data. The determination module 14 may further be configured to determine second color allocation ratios of the plurality of set colors according to the first color allocation ratios and the second attribute data and to determine third color allocation ratios of the plurality of set colors according to the second color allocation ratios and the third attribute data, thereby obtaining the color ratio allocation table.

Further, referring to FIG. 3, in some embodiments, the processor 20 may be configured to determine first color allocation ratios of the plurality of set colors according to a range of the first attribute data, determine second color allocation ratios of the plurality of set colors according to the first color allocation ratios and the second attribute data, and determine third color allocation ratios of the plurality of set colors according to the second color allocation ratios and the third attribute data, thereby obtaining the color ratio allocation table.

It should be noted that since the set color data is HSV data, and an HSV value is composed of hue H, saturation S and value V, it can be understood that the first attribute data is hue data H, the second attribute data includes saturation data S and the third attribute data includes value data V.

Figure 8:
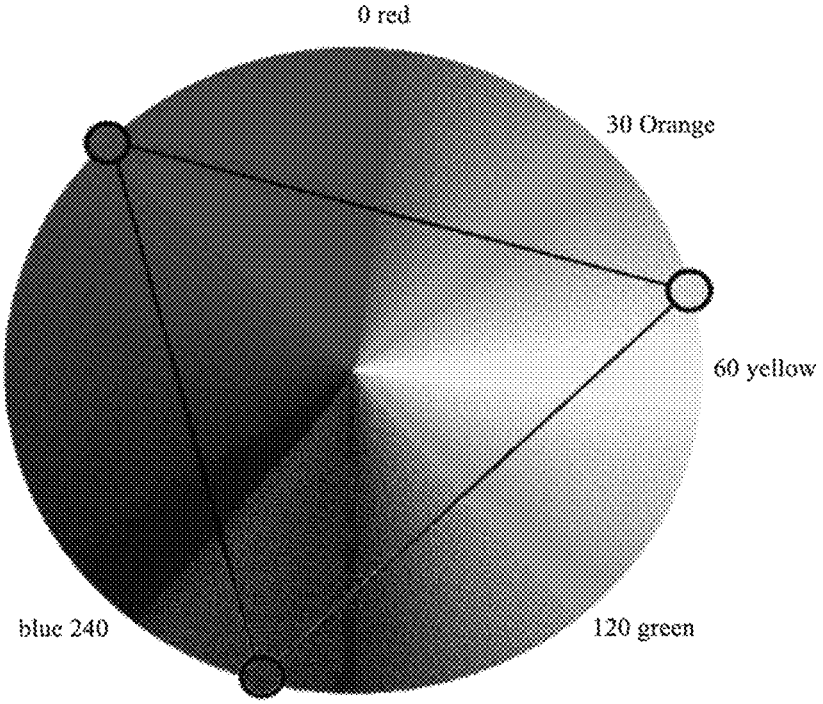
FIG. 8 is a schematic diagram of color alternation of an HSV space according to some embodiments of the present application.

In conjunction with FIG. 8, it should be noted that in the HSV color space, the saturation S and the value V of the five colors of red, orange, yellow, green and blue are all 100%. When the saturation and the value are all 100%, distribution ranges of red, orange, yellow, green and blue can be locked according to the value of hue H. When H=0, red; when H=30, orange; when H=60, yellow; when H=120, green; when H=240, blue. When 0<H<30, intermediate colors can be obtained by alternating red and orange colors; and as the value of H increases, the appearance probability of red decreases and the appearance probability of orange increases. When 30<H<60, intermediate colors can be obtained by alternating orange and yellow colors; and as the value of H increases, the appearance probability of orange decreases and the appearance probability of yellow increases. By analogy, the intermediate colors of two adjacent colors, i.e., the intermediate mixed colors of two adjacent colors, should be formed by alternately mixing the two adjacent colors, and the mixing ratio is determined according to a distance and proximity of H value. Furthermore, as the saturation S decreases, the appearance probability of white increases; as the value of V decreases, the appearance probability of black increases. Therefore, the processor 20 can calculate a ratio of each color based on the hue data H, the saturation data S, and the value data V of the set color through the color ratio allocation table.

Specifically, the color ratio allocation table includes a first color ratio allocation table Ratio H. The Ratio H is a 360×7 two-dimensional matrix, where Ratio[i][0] represents a ratio of red when H=i, S=100, V=100, Ratio[i][1] represents a ratio of orange when H=i, S=100, V=100, Ratio[i][2] represents a ratio of yellow when H=i, S=100, V=100, Ratio [i][3] represents a ratio of green when H=i, S=00, V=100, Ratio[i][4] represents a ratio of blue when H=i, S=100, V=100, Ratio[i][5] represents a ratio of white when H=i, S=100, V=100, Ratio[i][6] represents a ratio of black when H=i, S=00, V=100, 0≤i≤359, and i is a positive integer.

After generating the set color data, the processor 20 determines ranges of the hue data H, the saturation data S and the value V of the set color data, and first calculates the first color allocation ratio of each set color according to the hue data through the first color ratio allocation table with the following specific calculation formulas:

When $0 \le H < 30$, $Ratio[i][0]=1-H/29$, $Ratio[i][1]=H/29$, $Ratio[i][2]=0$, $Ratio[i][3]=0$, $Ratio[i][4]=0$, $Ratio[i][5]=0$, $Ratio[i][6]=0$.

When $30 \le H < 6$, $Ratio[i][0]=0$, $Ratio[i][1]=1-(H-30)/29$, $Ratio[i][2]=(H-30)/29$, $Ratio[i][3]=0$, $Ratio[i][4]=0$, $Ratio[i][5]=0$, $Ratio[i][6]=0$.

When $60 \le H < 120$, $Ratio[i][0]=0$, $Ratio[i][1]=0$, $Ratio[i][2]=1-(H-60)/59$, $Ratio[i][3]=(H-60)/59$, $Ratio[i][4]=0$, $Ratio[i][5]=0$, $Ratio[i][6]=0$.

When $120 \le H < 240$, $Ratio[i][0]=0$, $Ratio[i][1]=0$, $Ratio[i][2]=0$, $Ratio[i][3]=1-H/119$, $Ratio[i][4]=H/119$, $Ratio[i][5]=0$, $Ratio[i][6]=0$.

When $240 \le H < 360$, $Ratio[i][0]=(H-240)/119$, $Ratio[i][1]=0$, $Ratio[i][2]=0$, $Ratio[i][3]=0$, $Ratio[i][4]=1-(H-240)/119$, $Ratio[i][5]=0$, $Ratio[i][6]=0$.

Furthermore, the color ratio allocation table further includes a second color ratio allocation table $Ratio[360][7]_S$, and the processor can calculate second color allocation ratios of the plurality of set colors according to the first color allocation ratios and the saturation of the set color data via the second color ratio allocation table $Ratio[360][7]_S$. The specific calculation formulas of the second color ratio allocation table $Ratio[360][7]_S$ are as follows:

$$Ratio[H][0]_S=Ratio[H][0]*S/100$$

$$Ratio[H][1]_S=Ratio[i][1]*S/100$$

$$Ratio[H][2]_S=Ratio[i][2]*S/100$$

$$Ratio[H][3]_S=Ratio[i][3]*S/100$$

$$Ratio[H][4]_S=Ratio[i][4]*S/100$$

$$Ratio[H][5]_S=Ratio[i][5]*S/100+(1-S/100)$$

$$Ratio[H][6]_S=Ratio[i][6]*S/100$$

Where $Ratio[H][0]_S$ is a ratio of red in the second color ratio, and $Ratio[H][1]_S$ is a ratio of orange in the second color ratio; $Ratio[H][2]_S$ is a ratio of yellow in the second color ratio, $Ratio[H][3]_S$ is a ratio of green in the second color ratio, $Ratio[H][4]_S$ is a ratio of blue in the second color ratio, $Ratio[H][5]_S$ is a ratio of black in the second color ratio, $Ratio[H][6]_S$ is a ratio of white in the second color ratio.

Furthermore, the color ratio allocation table further includes a third color ratio allocation table $Ratio[360][7]_{SV}$. The processor can calculate third color allocation ratios of the plurality of set colors according to the second color allocation ratios and the value of the set color data. The specific calculation formulas of the third color ratio allocation table $Ratio[360][7]_{SV}$ are as follows:

$$Ratio[H][0]_{SV}=Ratio[H][0]_S*V/100$$

$$Ratio[H][1]_{SV}=Ratio[i][1]_S*V/100$$

$$Ratio[H][2]_{SV}=Ratio[i][2]_S*V/100$$

$$Ratio[H][3]_{SV}=Ratio[i][3]_S*V/100$$

$$Ratio[H][4]_{SV}=Ratio[i][4]_S*V/100$$

$$Ratio[H][5]_{SV}=Ratio[i][5]_S*V/100$$

$$Ratio[H][6]_{SV}=Ratio[i][6]_S*V/100+(1-V/100)$$

Where $Ratio[H][0]_{SV}$ is a ratio of red in the third color ratio, and $Ratio[H][1]_{SV}$ is a ratio of orange in the third color ratio; $Ratio[H][2]_{SV}$ is a ratio of yellow in the third color ratio, $Ratio[H][3]_{SV}$ is a ratio of green in the third color ratio, $Ratio[H][4]_{SV}$ is a ratio of blue in the third color ratio, $Ratio[H][5]_{SV}$ is a ratio of black in the third color ratio, $Ratio[H][6]_{SV}$ is a ratio of white in the third color ratio.

Figure 9:
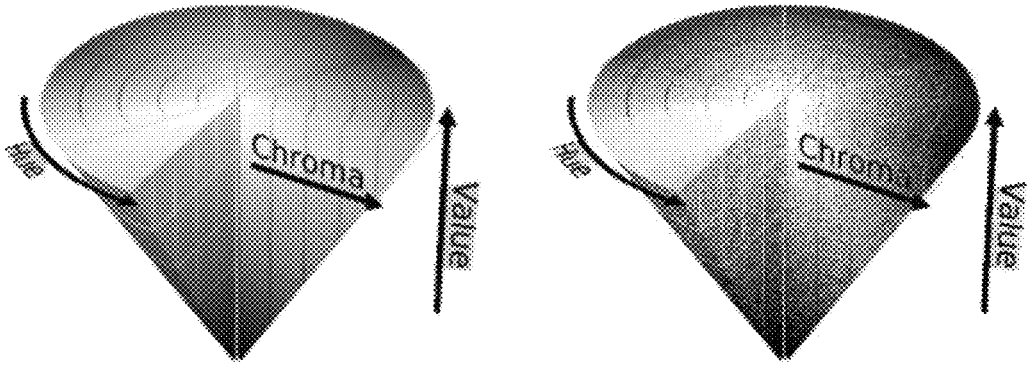
FIG. 9 is a schematic diagram of an RGB color space and an HSV color space according to some embodiments of the present application.

Referring to FIG. 9, the ratios of the corresponding seven colors can be directly indexed according to the values of the hue data H, the saturation data S, and the value data V of the set color data.

In addition, it should be noted that in the above embodiment, the color ratio allocation shows an allocation ratio corresponding to seven colors; and in other embodiments, if the set colors are not transformed into seven colors, the corresponding ration distribution table can be designed according to the number and distribution of the set colors.

Figure 10:
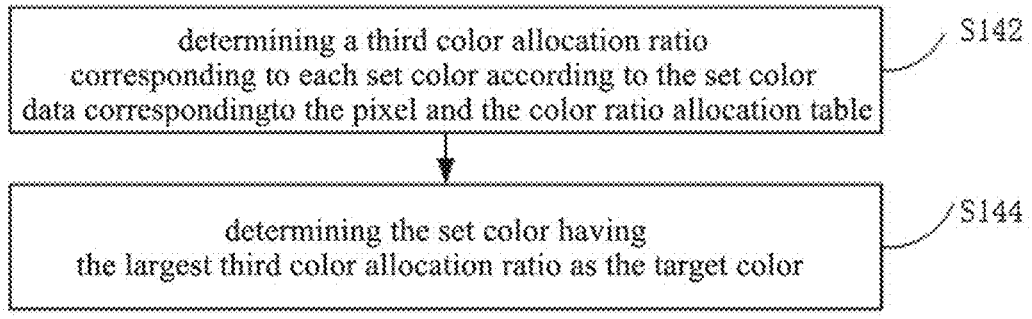
FIG. 10 is a flowchart of a color image processing method according to some embodiments of the present application.

Referring to FIG. 10, in some embodiments, the step S14 further includes:

Step S142: determining a third color allocation ratio corresponding to each set color according to the set color data corresponding to the pixel and the color ratio allocation table; and Step S144: determining the set color having the largest third color allocation ratio as the target color.

Referring further to FIG. 2, in some embodiments, the steps S142 and S144 may be performed by the determination module 14.

In other words, the determination module 14 may be configured to determine a third color allocation ratio corresponding to each set color according to the set color data corresponding to the pixel and the color ratio allocation table.

The determination module 14 may further be configured to determine the set color having the largest third color allocation ratio as the target color.

In some embodiments, the processor 20 may be configured to determine a third color allocation ratio corresponding to each set color according to the set color data corresponding to the pixel and the color ratio allocation table. The processor 20 may further be configured to determine the set color having the largest third color allocation ratio as the target color.

It should be understood that when the original image is transformed into the target image, it is necessary to restore and retain the original information in the target image to the maximum extent, i.e., transforming each original color in the original image into corresponding closest color. The third color allocation ratio is calculated from the hue, saturation and value of the set color data, and the larger the third color allocation ratio of the set color is, the closer the color is to the set color is. Therefore, the target color can be determined according to the third color allocation ratio. Specifically, after calculating a third color allocation ratio corresponding to each set color according to the third color ratio allocation table, a size of each third color allocation ratio is compared, and the set color with the largest third color allocation ratio is the target color.

For example, in some examples, the set color data is to (80, 100, 50), then according to the third color allocation ratio table, the following contents can be obtained: Ratio $[H][0]_{SV}=0$, Ratio$[H][1]_{SV}=0$, Ratio$[H][2]_{SV}=(39/59)*(100/100)*(50/100)=39/118$. Ratio$[H][3]_{SV}=(20/59)*(100/100)*(50/100)=10/59$. Ratio$[H][6]_{SV}=0$. Ratio$[H][5]_{SV}=0$. Ratio $[H][6]_{SV}=(1-50/100)$. Ratio$[H][2]_{SV}$ is the largest, Ratio$[H][2]_{SV}$ corresponds to a yellow color, and then the target color is yellow.

Figure 11:
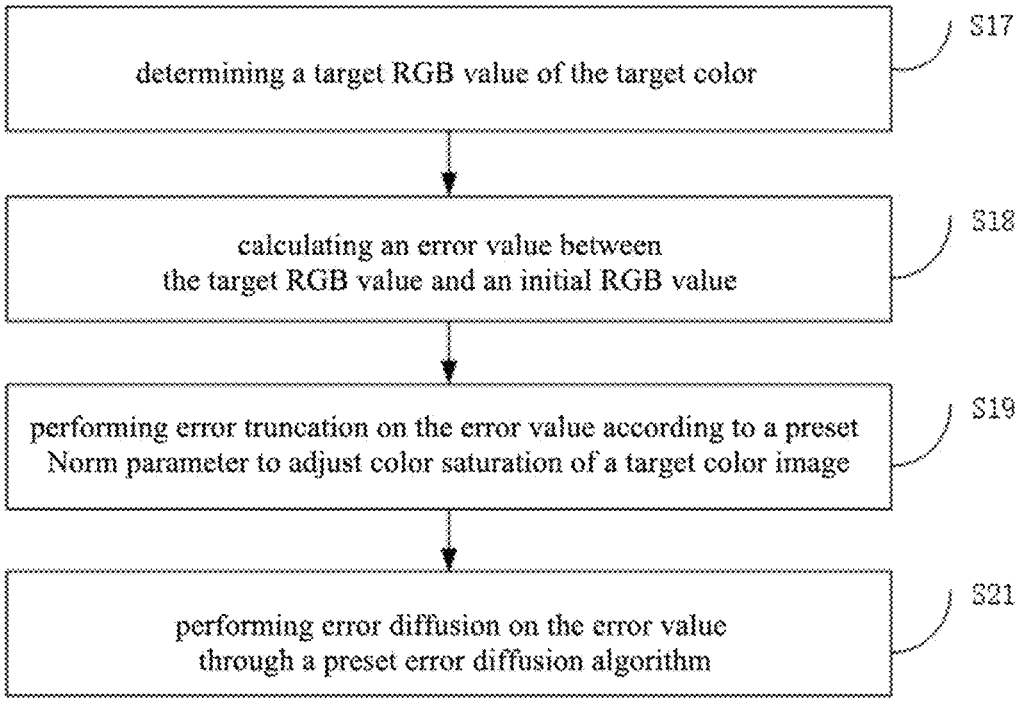
FIG. 11 is a flowchart of a color image processing method according to some embodiments of the present application.

Referring to FIG. 11, in some embodiments, the color image data processing method further includes:

Step S17: determining a target RGB value of the target color;

Step S18: calculating an error value between the target RGB value and an initial RGB value;

Step S19: performing error truncation on the error value according to a preset Norm parameter to adjust color saturation of a target color image; and Step S21: performing error diffusion on the error value through a preset error diffusion algorithm.

Referring to FIG. 2, in some embodiments, the color image processing device further includes a calculation module 18 and an adjustment module 19.

The step S17 may be implemented by the determination module 16, the step S18 may be implemented by the calculation module 18, and the step S19 and step S21 may be implemented by the adjustment module 19.

In other word, the determination module 16 may be configured to determine a target RGB value of the target color.

The calculation module implementation 18 may be configured to calculate an error value between the target RGB value and an initial RGB value.

The adjustment module 19 may be configured to perform error truncation on the error value according to a preset Norm parameter to adjust color saturation of a target color image and perform error diffusion on the error value through a preset error diffusion algorithm.

In some embodiments, the processor 20 may be configured to determine a target RGB value of the target color and calculate an error value between the target RGB value and an initial RGB value. The processor 20 may further be configured to perform error truncation on the error value according to a preset Norm parameter to adjust color saturation of a target color image, and perform error diffusion on the error value through a preset error diffusion algorithm.

It should be noted that after the original color data of the pixels in the original image is transformed into the set color data and then mapped into the target color through the color ratio allocation table, the generated target image generates a visual error which brings a bad experience to the user. Therefore, it is necessary to adjust the target image so as to ensure that the target image can clearly reflect visual information of the original image to improve the user experience.

Specifically, after generating the target image, the processor 20 may further determine a target RGB value of the target color and an initial RGB value of the original image data, and calculate an initial difference between the target RGB value and the corresponding initial RGB value according to a formula.

Figure 12:
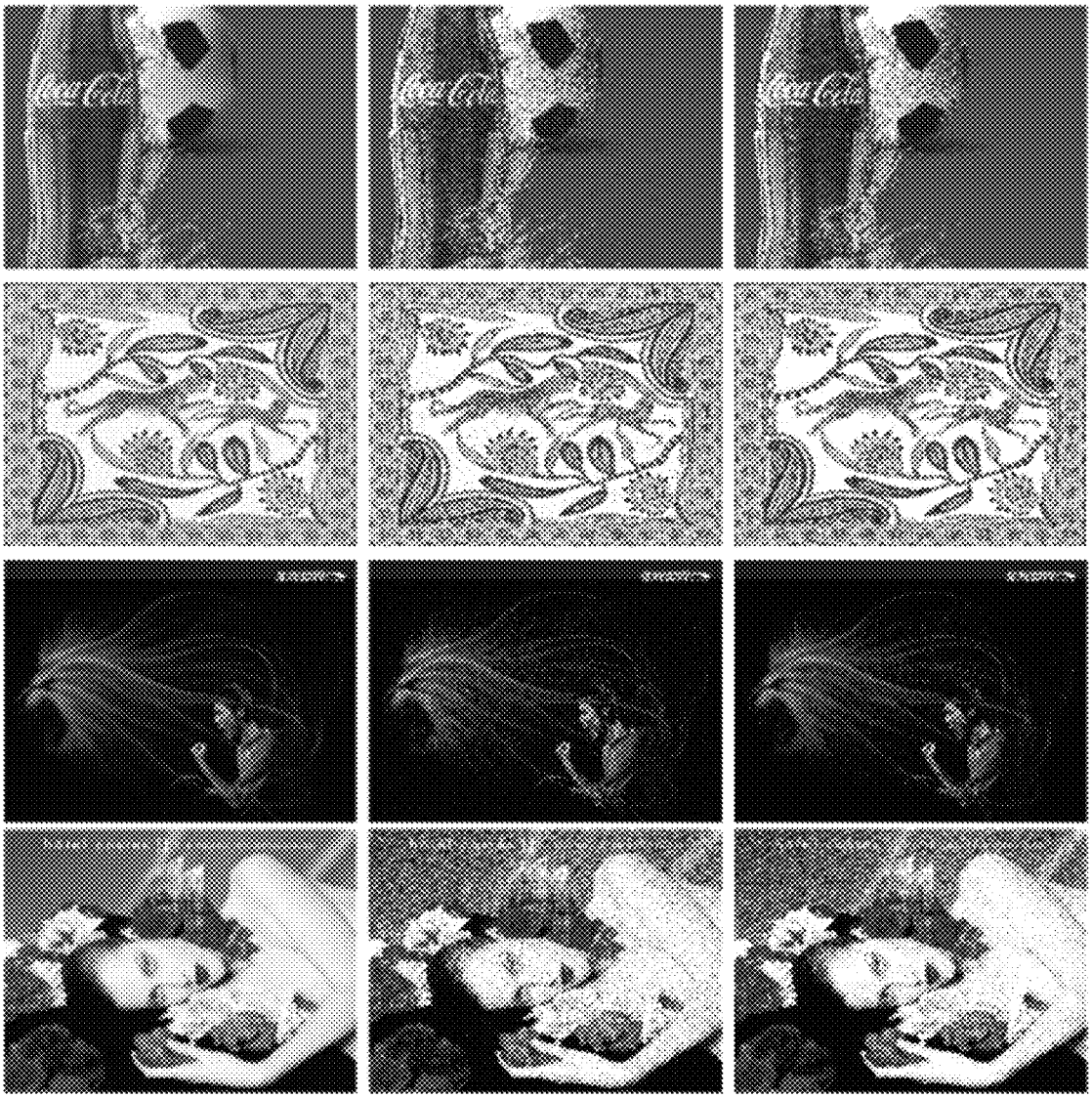
FIG. 12 is a schematic diagram of comparison between an original image and a target image generated by truncating accuracy of an error using a parameter Norm according to some embodiments of the present application.

In conjunction with FIG. 12, the processor 20 includes a preset Norm parameter. The parameter Norm is used for truncating accuracy of an initial difference value to generate a target difference value, so that the target image can be adjusted according to the target difference value, thereby achieving control of color saturation and reducing color dither range of the target image. A specific calculation formula for truncating the initial difference is:

$$\text{Target difference}=\text{floor}(\text{initial difference}*\text{Norm})*\text{Norm}$$

where floor ( ) is a function of rounding down; Norm is a positive integer. The smaller the Norm is, the greater the degree of truncation is. In this way, the color dithering can be effectively reduced, thereby improving graininess of a mapped image and increasing the color saturation.

Furthermore, a window error calculation is performed on the target image. An error diffusion algorithm, also referred to as a dithering algorithm, is an image half-toning method, which can allocate quantization error of a central pixel to an adjacent position which has not been processed around it, and is commonly used to transform an image with multiple grey levels into a black and white image with only two grey levels, so as to enhance an image boundary and make the visual effect of the image better.

Figure 13:
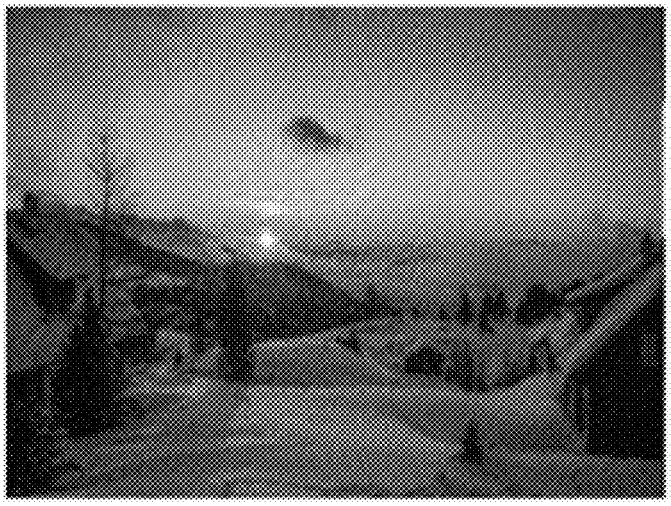
FIG. 13 is a schematic diagram showing effects of processing using a Floyd-Steinberg dithering algorithm according to some embodiments of the present application.
Figure 14:
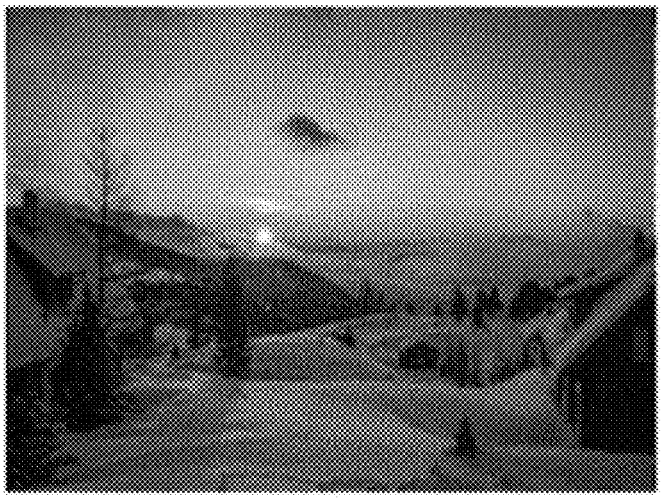
FIG. 14 is a schematic diagram showing effects of processing using a JF Jarvis dither algorithm according to some embodiments of the present application.

The window error diffusion algorithms include the Floyd-Steinberg dithering algorithm and the JF Jarvis dithering algorithm. In the present application, the target image may be processed through the Floyd-Steinberg dithering algorithm (as shown in FIG. 13) to adjust the target image, and the target image may be processed through the JF Jarvis dithering algorithm (as shown in FIG. 14) to adjust the target image.

The floyd-Steinberg dithering algorithm, proposed by Robert W. Floyd and Louis Steinberg in 1976, is widely used in image processing tools. The Floyd-Steinberg dithering algorithm can diffuse quantization residual of a central pixel to surrounding 4 pixels with the following specific calculation formula:

$$\frac{1}{16}\begin{bmatrix} & * & 7 \\ 3 & 5 & 1 \end{bmatrix}$$

where * refers to a value of a pixel currently being processed. If there is no pixel at a right of the pixel, only pixels below and at a lower left of the pixel are converted according to the above coefficients.

The JF Jarvis dithering algorithm changes the diffusion window to 5*5, and using a larger window can minimize an average error, so that the target image has a better smoothing effect. A specific calculation formula of the Floyd-Steinberg dithering algorithm is as follows:

$$\frac{1}{48}\begin{bmatrix} & & * & 7 & 5 \\ 3 & 5 & 7 & 5 & 3 \\ 1 & 3 & 5 & 3 & 1 \end{bmatrix}$$

where * refers to a value of a pixel currently being processed.

In the several embodiments provided herein, it should be understood that the disclosed systems, devices, and methods may be implemented in other ways. For example, the device embodiments described above are merely illustrative. For example, division of modules is merely a logical function division, and in practice there may be additional divisions. For example, modules or components may be combined or integrated into another system, or some features may be omitted or not performed. In another aspect, couplings or direct couplings or communication connections shown or discussed with respect to each other may be indirect couplings or communication connections through some interface, means, or element, and may be electrical, mechanical, or otherwise.

In addition, each functional module in each embodiment of the present application may be integrated in one processing unit, or may physically exist separately, or two or more units may be integrated in one unit.

The foregoing is only a description of the preferred embodiments of the present application and the applied technical principles. It should be appreciated by those skilled in the art that the inventive scope of the present application is not limited to the technical solutions formed by the particular combinations of the above technical features. The inventive scope should also cover other technical solutions formed by any combinations of the above technical features or equivalent features thereof without departing from the concept of the invention, such as, technical solutions formed by replacing the features as disclosed in the present application with (but not limited to), technical features with similar functions.

What is claimed is:

1. A color image processing method, comprising:

obtaining an original image, and transforming original color data of a pixel in the original image into corresponding set color data in a set color space;

determining a target color corresponding to the pixel in a plurality of set colors according to the set color data corresponding to the pixel and a color ratio allocation table; and generating a target image according to the target color;

wherein the set color data includes first attribute data, second attribute data and third attribute data; the color image processing method further includes:

determining first color allocation ratios of a plurality of set colors according to a range of the first attribute data;

determining second color allocation ratios of the plurality of set colors according to the first color allocation ratios and the second attribute data; and determining third color allocation ratios of the plurality of set colors according to the second color allocation ratios and the third attribute data, thereby obtaining the color ratio allocation table;

wherein the set color space includes an HSV color space; the first attribute data includes hue data; the second attribute data includes saturation data; and the third attribute data includes value data.

2. The method according to claim 1, wherein the determining a target color corresponding to the pixel in a plurality of set colors according to the set color data corresponding to the pixel and a color ratio allocation table, includes:

determining a third color allocation ratio corresponding to each set color according to the set color data corresponding to the pixel and the color ratio allocation table; and determining the set color having a largest third color allocation ratio as the target color.

3. The method according to claim 1, wherein the plurality of set colors include black and white, and any one or more of red, orange, yellow, green, and blue.

4. The method according to claim 1, wherein the color image processing method further includes:

determining a target RGB value of the target color;

calculating an error value between the target RGB value and an initial RGB value;

performing error truncation on the error value according to a preset Norm parameter to adjust color saturation of a target color image; and performing error diffusion on the error value through a preset error diffusion algorithm.

5. The method according to claim 4, wherein the preset error diffusion algorithm includes: a Floyd-Steinberg dithering algorithm and a JF Jarvis dithering algorithm.

6. An electronic ink screen, comprising:

a processor and a memory; and one or more programs stored in the memory and executed by the processor;

wherein the processor executes the one or more programs to perform:

obtaining an original image, and transforming original color data of a pixel in the original image into corresponding set color data in a set color space;

determining a target color corresponding to the pixel in a plurality of set colors according to the set color data corresponding to the pixel and a color ratio allocation table; and generating a target image according to the target color wherein the set color data includes first attribute data, second attribute data and third attribute data; the processor executes the one or more programs to perform:

determining first color allocation ratios of a plurality of set colors according to a range of the first attribute data;

determining second color allocation ratios of the plurality of set colors according to the first color allocation ratios and the second attribute data; and determining third color allocation ratios of the plurality of set colors according to the second color allocation ratios and the third attribute data, thereby obtaining the color ratio allocation table;

wherein the set color space includes an HSV color space; the first attribute data includes hue data; the second attribute data includes saturation data; and the third attribute data includes value data.

7. The electronic ink screen according to claim 4, wherein when determining a target color corresponding to the pixel in a plurality of set colors according to the set color data corresponding to the pixel and a color ratio allocation table, the processor executes the one or more programs to perform:

determining a third color allocation ratio corresponding to each set color according to the set color data corresponding to the pixel and the color ratio allocation table; and determining the set color having a largest third color allocation ratio as the target color.

8. The electronic ink screen according to claim 6, wherein the plurality of set colors include black and white, and any one or more of red, orange, yellow, green, and blue.

9. The electronic ink screen according to claim 6, wherein the processor executes the one or more programs to perform:

determining a target RGB value of the target color;

calculating an error value between the target RGB value and an initial RGB value;

performing error truncation on the error value according to a preset Norm parameter to adjust color saturation of a target color image; and performing error diffusion on the error value through a preset error diffusion algorithm.

10. The electronic ink screen according to claim 9, wherein the preset error diffusion algorithm includes: a Floyd-Steinberg dithering algorithm and a JF Jarvis dithering algorithm.

11. A non-volatile computer-readable storage medium, comprising a computer program stored thereon; wherein the computer program is executed by one or more processors to causes the processors to perform:

obtaining an original image, and transforming original color data of a pixel in the original image into corresponding set color data in a set color space;

determining a target color corresponding to the pixel in a plurality of set colors according to the set color data corresponding to the pixel and a color ratio allocation table; and generating a target image according to the target color;

wherein the set color data includes first attribute data, second attribute data and third attribute data; the computer program is executed by one or more processors to causes the processors to perform:

determining first color allocation ratios of a plurality of set colors according to a range of the first attribute data;

determining second color allocation ratios of the plurality of set colors according to the first color allocation ratios and the second attribute data; and determining third color allocation ratios of the plurality of set colors according to the second color allocation ratios and the third attribute data, thereby obtaining the color ratio allocation table;

wherein the set color space includes an HSV color space; the first attribute data includes hue data; the second attribute data includes saturation data; and the third attribute data includes value data.

12. The non-volatile computer-readable storage medium according to claim 11, wherein when determining a target color corresponding to the pixel in a plurality of set colors according to the set color data corresponding to the pixel and a color ratio allocation table, the computer program is executed by one or more processors to causes the processors to perform:

determining a third color allocation ratio corresponding to each set color according to the set color data corresponding to the pixel and the color ratio allocation table; and determining the set color having a largest third color allocation ratio as the target color.

13. The non-volatile computer-readable storage medium according to claim 11, wherein the computer program is executed by one or more processors to causes the processors to perform:

determining a target RGB value of the target color;

calculating an error value between the target RGB value and an initial RGB value;

performing error truncation on the error value according to a preset Norm parameter to adjust color saturation of a target color image; and performing error diffusion on the error value through a preset error diffusion algorithm.

14. The non-volatile computer-readable storage medium according to claim 13, wherein the preset error diffusion algorithm includes: a Floyd-Steinberg dithering algorithm and a JF Jarvis dithering algorithm.

* * * * *